US010717317B2

(12) United States Patent
Nobi

(10) Patent No.: US 10,717,317 B2
(45) Date of Patent: Jul. 21, 2020

(54) ANIMAL SKULL MOUNT CLIP SYSTEM AND METHOD OF USE

(71) Applicant: John Nobi, Stevensville, MT (US)

(72) Inventor: John Nobi, Stevensville, MT (US)

( * ) Notice: Subject to any disclaimer, the term of this patent is extended or adjusted under 35 U.S.C. 154(b) by 469 days.

(21) Appl. No.: 15/268,227

(22) Filed: Sep. 16, 2016

(65) Prior Publication Data

US 2017/0080745 A1 Mar. 23, 2017

Related U.S. Application Data

(60) Provisional application No. 62/220,445, filed on Sep. 18, 2015.

(51) Int. Cl.
*B44C 5/02* (2006.01)

(52) U.S. Cl.
CPC ..... *B44C 5/02* (2013.01)

(58) Field of Classification Search
CPC ..... G09B 23/36; B44C 5/00; B44C 5/02
USPC ..... 434/295, 296; 248/222.14, 346.04, 500, 248/510; 24/295; 411/112, 970
See application file for complete search history.

(56) References Cited

U.S. PATENT DOCUMENTS 2,698,472 A * 1/1955 Knohl ..... F16B 5/125 24/295
4,464,440 A 8/1984 Dotzman
4,971,865 A 11/1990 Nowlan
5,472,765 A 12/1995 Green
5,722,124 A * 3/1998 Wisniewski ..... F16B 5/0657 24/295
5,927,515 A * 7/1999 Llaurado Morant .. A47G 25/10 211/32
6,170,185 B1 * 1/2001 Donofrio, Jr. ..... A47G 25/10 211/30
7,243,888 B2 * 7/2007 Peek ..... B44C 5/02 248/304
8,459,601 B2 6/2013 Shaw
8,616,516 B2 * 12/2013 Rittner ..... B64C 1/403 24/453
9,248,696 B2 2/2016 Maria
D760,066 S * 6/2016 Krenek ..... F16B 5/0657 D8/354
9,428,003 B2 * 8/2016 Gill, Jr. ..... B44C 5/02
9,626,881 B1 * 4/2017 Herron ..... G09B 23/36
2006/0154224 A1 * 7/2006 St.Ama ..... G09B 23/36 434/296
2012/0219731 A1 8/2012 Paragamian
2013/0014373 A1 * 1/2013 Jordan ..... B29C 39/026 29/428
2014/0230220 A1 8/2014 Allred et al.
(Continued)

*Primary Examiner* — Jonathan Liu
*Assistant Examiner* — Guang H Guan
(74) *Attorney, Agent, or Firm* — Haffey Vap PLLC; John F. Haffey

(57) ABSTRACT

An animal skull mount clip system comprising a base, flexible legs extending from the base, and a mounting stud configured to attach the base to a mounting surface, where the flexible legs are configured to be inserted into a brain cavity of an animal skull through a foramen magnum of the animal skull by being flexed toward each other to clear the foramen magnum before expanding back to their original positions, thereby allowing the animal skull to be attached to the mounting surface by the flexible legs within the animal skull and the mounting stud.

1 Claim, 3 Drawing Sheets

(56) References Cited

U.S. PATENT DOCUMENTS

| | | | | |
|---|---|---|---|---|
| 2015/0076731 | A1 | 3/2015 | Walton, Jr. | |
| 2017/0080745 | A1* | 3/2017 | Nobi | B44C 5/02 |

* cited by examiner

ANIMAL SKULL MOUNT CLIP SYSTEM AND METHOD OF USE

CROSS-REFERENCE TO RELATED APPLICATIONS

This application claims the benefit of U.S. Provisional Application No. 62/220,445 filed Sep. 18, 2015, the disclosure of which is incorporated herein by reference.

FIELD OF THE INVENTION

The present invention relates to an animal skull mount clip system that is inserted into the foramen magnum of an animal skull and is formed to grasp the inside of the skull in the brain cavity, and then press fit on a mounting stud for placement on a wall, plaque or other mounting surface.

BACKGROUND OF THE INVENTION

Taxidermists use various techniques to mount hunting trophies to a wall or plaque. Some techniques simply use a metal or wood hanger with a hook, wherein the skull simply sits on the hook. Another method uses a "molly" bolt that is inserted into the back of the skull and expanded. Another method involves packing the brain cavity with fill material and inserting a dowel into the cavity through the foramen magnum, which can then be attached to a plaque. Another common method simply involves using screws driven through a plaque and then directly into the bones of the skull.

While all these methods are workable, they all have drawbacks, such as possible damage to the skull, skull movement on the mount, inability to easily remove the trophy from the mount, and excessive time involved to properly set up the mount. Therefore, an improved mounting device to eliminate those drawbacks is desirable. The present invention is simple to use, provides for solid mounting, saves time and money, can attach to most surfaces, is esthetically pleasing having no unsightly screws or dowels or hook components, and will not harm the animal skull.

SUMMARY OF THE INVENTION

The invention comprises a clip system that is inserted into the brain cavity through the spinal cord opening (foramen magnum). The system is formed from a piece of suitable material of sufficient thickness to allow for bends and curves and having the ability to return to the original shape after deflection needed for insertion into the brain cavity, such as spring steel. The system may also be formed to its final shape through use of molds or casts, and utilize materials such as plastics and carbon fiber. The system has a center base and a front leg and rear leg extending away from the base. The legs have widths smaller than the size of the opening of the skull's foramen magnum. The legs are formed such that they grasp the inside of the skull at both the front and the rear of the brain cavity. The system is prevented from falling into the skull by having the base sized larger than the opening of the foramen magnum. The front leg has a narrow section proximate to the base that allows the leg to be positioned at the anterior aspect of the foramen magnum. The narrow section of the leg has two reverse bends that positions the front leg above the base. The narrow section of the front leg transitions to a wide section having a rounded end. The wide section of the front leg is curved downward and away from the base to allow for positioning inside the brain cavity and for pressing against the skull adjacent to the anterior aspect of the foramen magnum. The rear leg has a uniform width that is wider than the narrow section of the front leg, but narrower than the wide section of the front leg. The rear leg has two smooth radius reverse bends making the clip extend away from the base generally perpendicular to the base and allows the rear leg to pass between projections in the brain cavity proximate to the posterior aspect of the foramen magnum, which prevents the clip from rotating in the skull. The base has a hexagonal hole with slots extending outward from each vertex, which then receives a stud having a top and bottom end for a snug slip fit similar to a "push nut." The hole in the base can be other configurations such as round, square or other multisided shapes. The stud can be any shape desired and can be mounted to a plaque or wall by utilizing a screw through the mounting surface to the bottom end of the stud having female threads. The stud is of a length that allows it to hold the front and rear legs in position in the animal skull when the stud is pushed through the base of the clip.

DESCRIPTION OF THE PREFERRED EMBODIMENT

Although only one embodiment is explained in detail, it is to be understood as an illustration only, and not intended to limit the invention in its scope. Also, in describing the embodiment specific terminology may be used, but it should be understood that specific terms include all technical equivalents that operate in similar manners to accomplish similar purposes.

Figure 1:
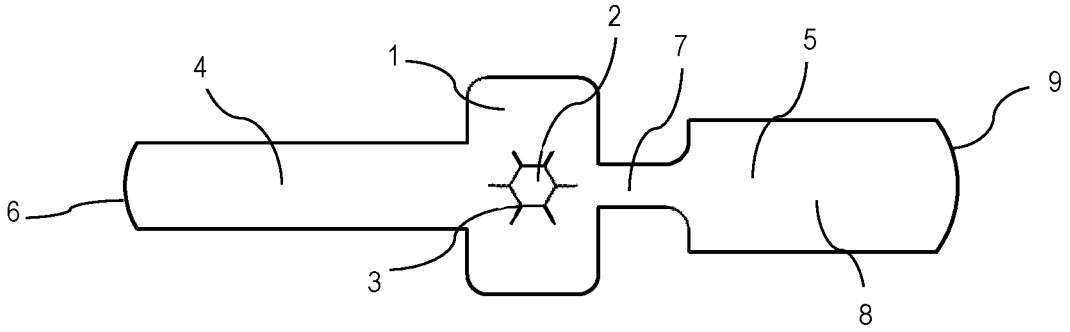
FIG. 1 is a top view of the embodiment of the mounting system shown before the front and rear legs are formed for placement in the animal skull.
Figure 2:
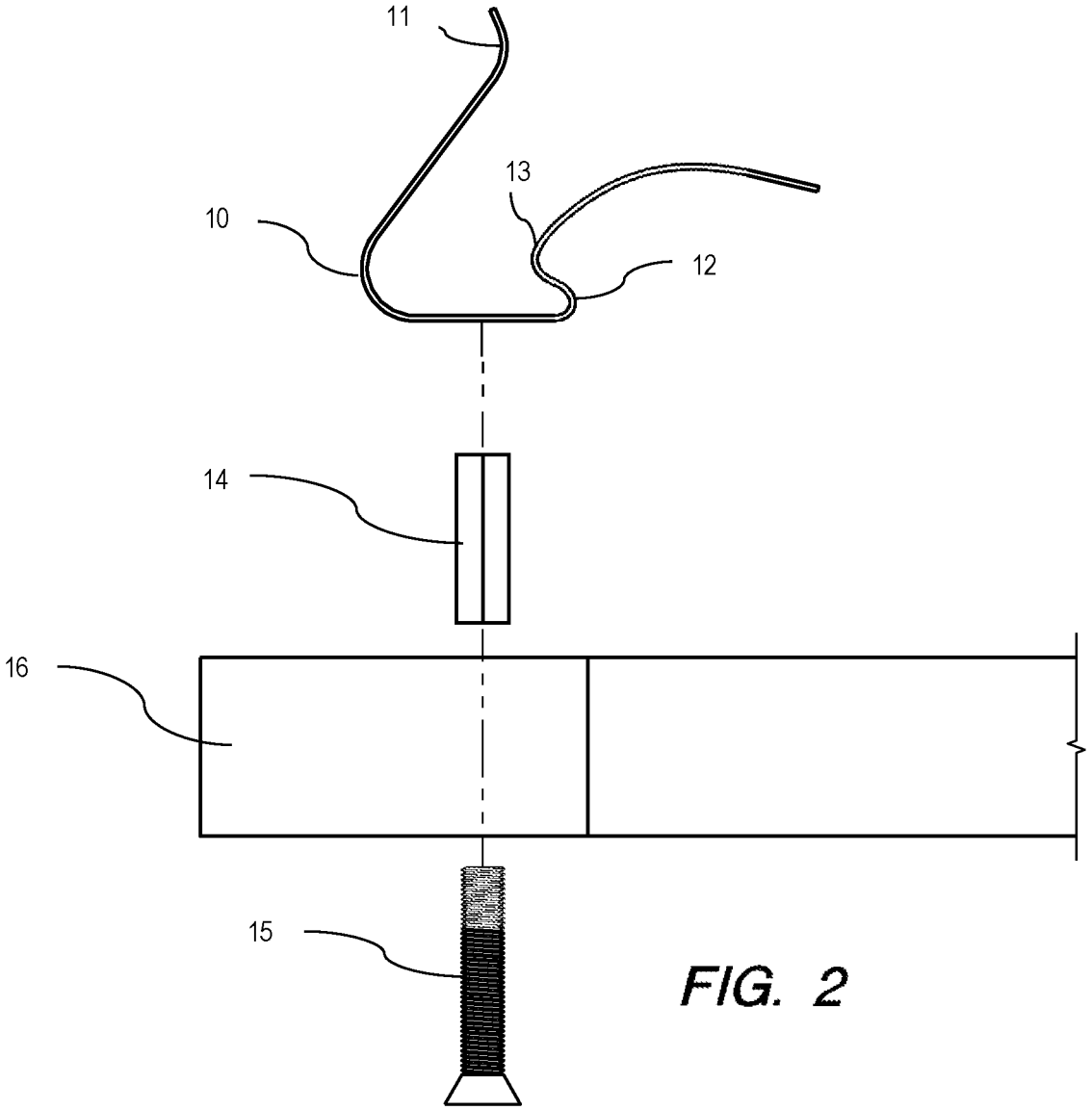
FIG. 2 is a side view of the embodiment showing the legs formed for placement in the skull and showing the mounting stud, mounting surface, and screw for attaching the stud to the mounting surface.
Figure 3:
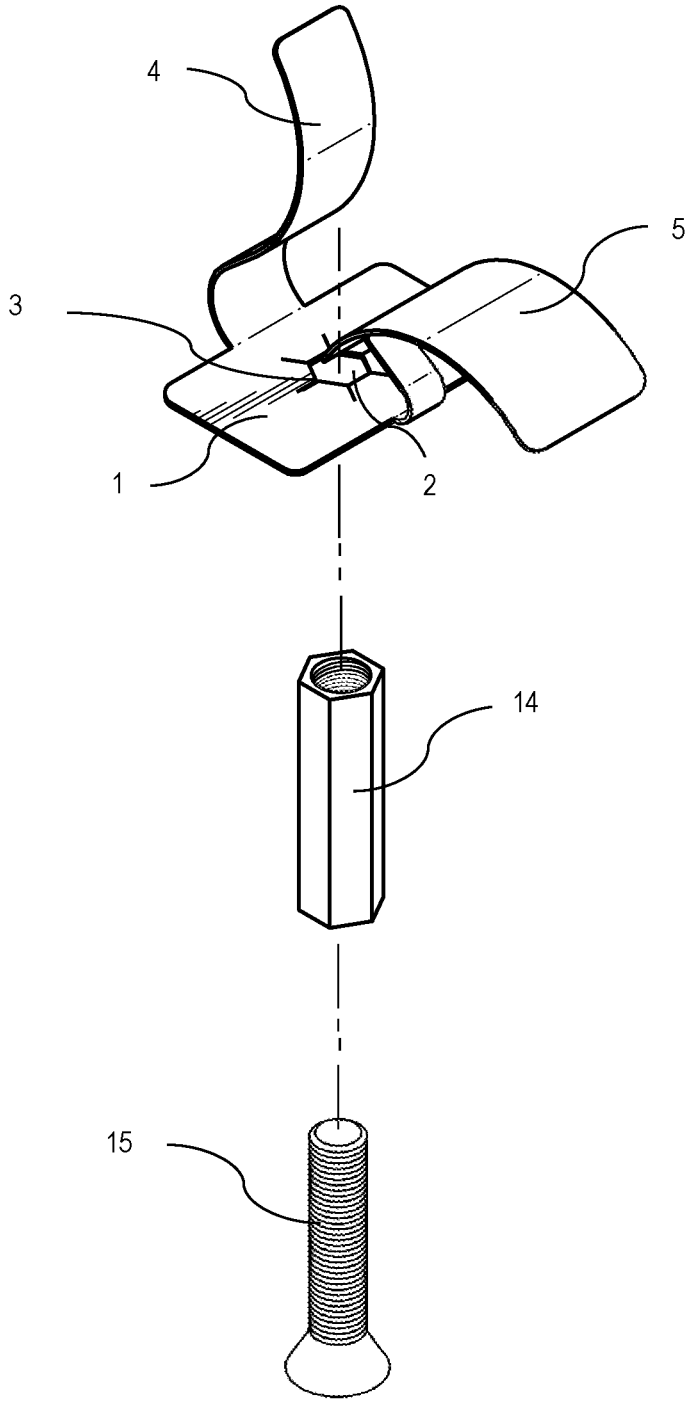
FIG. 3 is a perspective view of the embodiment.
Figure 4:
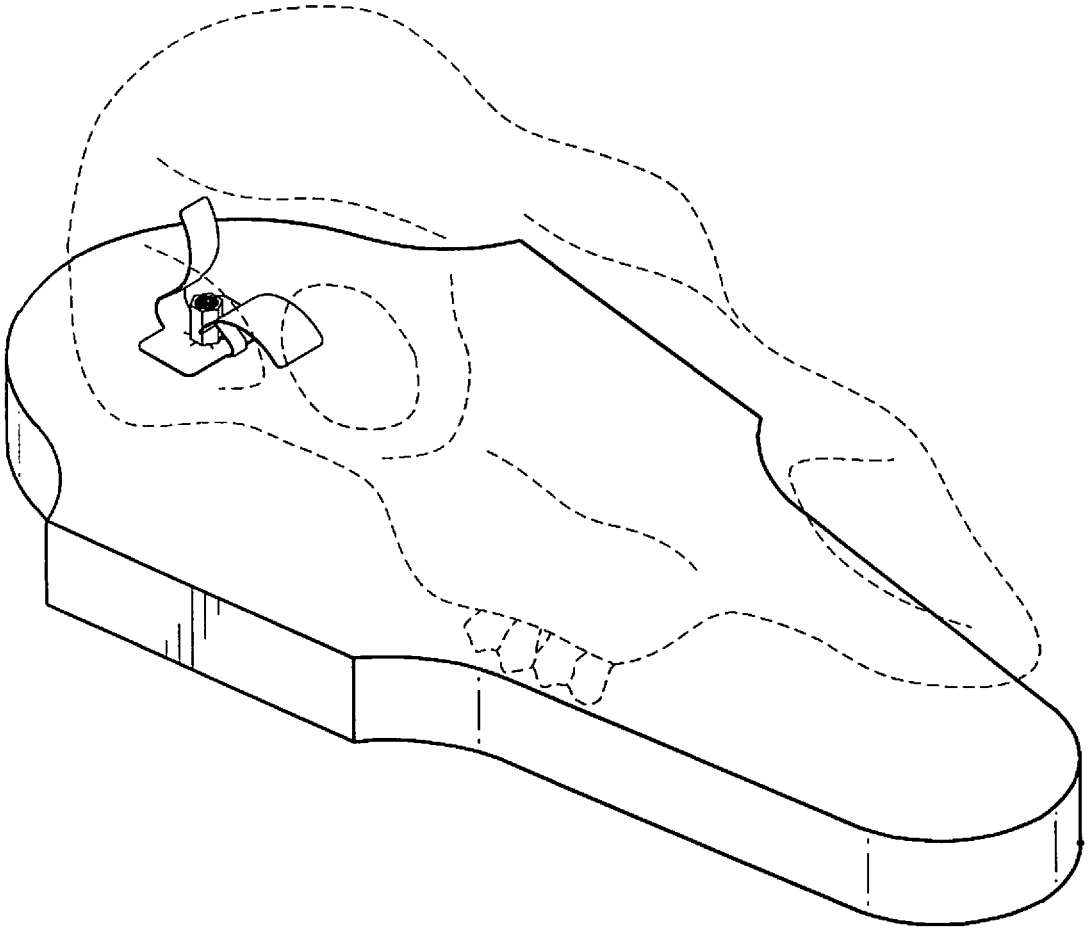
FIG. 4 is a perspective view showing the embodiment secured to an animal skull and a mounting surface.

With reference to the drawings, a preferred embodiment of this invention is illustrated in FIGS. 1-4. The system generally comprises a base plate 1, having a center hexagonal hole 2, with slots cut outward from the hexagon vertices 3, a rear leg 4 and a front leg 5. The rear leg has a uniform width sized to enter the foramen magnum of a skull and has a rounded end 6. The rear leg has a first reverse bend 10 proximate to the base plate and transitions to a second reverse bend 11 proximate to the end of the leg, thereby positioning the rear leg generally above and extending away from the base plate 1 and curved outward to press on the skull at the rear of the brain cavity. The front leg 5 has a narrow section 7 adjacent to the base plate 1 and a wide section 8 sized to enter the foramen magnum of a skull and to press against the skull interior proximate to the anterior aspect of the foramen magnum, and having a rounded end 9. The narrow section of the front leg 7 has a first reverse bend 12 proximate to the base and a second reverse bend 13 proximate to the wide section of the front leg, which brings the leg above the base before the wide section extends away from the base with a smooth radius-downward curvature. The hexagonal hole 2, receives a hexagonal stud 14 having a top and bottom end. The bottom end has female threads to receive a screw 15 for attachment to a mounting surface 16 such as a plaque or wall. The stud acts to keep the legs in place in the brain cavity after it is pressed through the hole in the base plate.

I claim:

1. An animal skull mount clip system comprising:

a base plate with a mounting hole;

a mounting stud for connection to a mounting surface, wherein the mounting stud is sized to fit within the mounting hole of the base plate;

a front leg connected to the base plate, wherein the front leg is sized to fit through a foramen magnum of an animal skull and into a brain cavity of the animal skull;

a rear leg connected to the base plate, wherein the rear leg is sized to fit through the foramen magnum of the animal skull and into the brain cavity of the animal skull;

wherein the base plate has a width to be larger than a width of the foramen magnum of the animal skull and is made from spring steel;

wherein the mounting hole of the base plate is hexagonal and having hexagonal vertices with slots cut outward from the hexagonal vertices;

wherein the front leg is made from spring steel and has an end that is rounded and wherein the front leg has a narrow section and a wide section, wherein the narrow section has a first reverse bend proximate to the base plate and a second reverse bend proximate to the wide section, and wherein the wide section of the front leg is curved upward from the narrow section of the front leg relative to the base plate and then curved downward relative to the base plate;

wherein the rear leg is made from spring steel and has an end that is rounded and wherein the rear leg has a fixed width, wherein the rear leg is wider than the narrow section of the front leg but narrower than the wide section of the front leg, and wherein the rear leg has a first reverse bend proximate to the base plate and a second reverse bend proximate to the end of the rear leg; and wherein the mounting stud is of sufficient length to pass beyond the second reverse bend of the narrow section of the front leg and wherein the mounting stud is hexagonal and has female threads at one or more ends to receive a screw for attaching to the mounting surface.

* * * * *